United States Patent [19]

Calvert

[11] Patent Number: 4,561,483

[45] Date of Patent: Dec. 31, 1985

[54] GUIDE TRACK FOR A FOLDING BARRIER

[75] Inventor: Eric F. Calvert, Morton Lodge, United Kingdom

[73] Assignee: Bostwick Doors (UK) Ltd., Chelsea, England

[21] Appl. No.: 558,861

[22] Filed: Dec. 7, 1983

[51] Int. Cl.[4] ..... E06B 3/92

[52] U.S. Cl. ..... 160/159; 49/411; 52/414; 160/351

[58] Field of Search ..... 160/159, 229 R, 135; 52/710, 241, 738, 109, 340, 321, 414; 49/411, 501

[56] References Cited

U.S. PATENT DOCUMENTS

| | | | |
|---|---|---|---|
| 1,660,408 | 2/1928 | Bayley | 52/710 X |
| 2,485,393 | 10/1949 | Locke | 49/411 X |
| 3,390,500 | 7/1968 | Schumak | 52/710 |
| 3,465,487 | 9/1969 | Fatosme et al. | 52/241 |

FOREIGN PATENT DOCUMENTS

| | | | |
|---|---|---|---|
| 848046 | 7/1939 | France | 160/235 |
| 0163291 | 3/1980 | Netherlands | 52/340 |

*Primary Examiner*—Ramon S. Britts
*Assistant Examiner*—Cherney S. Lieberman
*Attorney, Agent, or Firm*—Michael Williams; Warren N. Low; Renee S. Rutkowsk

[57] ABSTRACT

A guide track for the bottom ends of the pickets of a folding door or the like comprises a galvanized steel elongated channel member having upwardly diverging sidewalls extending from a basewall, and a securing flange inclined downwardly and outwardly from the top of each sidewall. The free edge of each sidewall is lipped and lies substantially in the plane of the basewall, the lips extending outwardly and upwardly from the securing flanges. The guide track is disposed in a recess in the floor with the concrete or like flooring material surrounding the securing flanges and lips, filling the space between each securing flange and the respective sidewall to support the sidewall, and encasing the lips to prevent dislodgement of the guide track.

8 Claims, 2 Drawing Figures

GUIDE TRACK FOR A FOLDING BARRIER

This invention relates to a guide track for a folding barrier, such as a folding door comprising a plurality of vertically arranged pickets mounted for sliding movement transversely of the door opening and a plurality of door leaves hinged to such pickets and to each other. In addition such folding door conventionally is provided with a lattice structure extending between the door pickets and slidably engaged therewith to slide in a direction longitudinally thereof. Conventionally also such a door is supported from the door frame structure so as to depend therefrom and the bottom of such a door is guided in a guide track extending along the floor between the vertical members of the door frame. Such a guide track is generally of channel formation.

In many cases it is required that vehicles and/or heavy equipment pass through a doorway to which such a door as described above is fitted. To facilitate such passage it is known to dispose the channel-shaped guide track in a channel provided in the floor, thereby avoiding any step formation over which the vehicle or equipment must pass. Although such an arrangement is satisfactory in certain applications, in other applications, particularly in the case of large and heavy doors and when large vehicles and/or very large, heavy equipment passes through a doorway at frequent intervals, the simple location of a guide track in a channel in the floor is inadequate. In such cases the loadings to which the track and surrounding floor are subjected by the door itself and by the vehicles and/or equipment can cause the guide track to become damaged and thereby loose and/or displaced from the channel in the floor. The provision of conventional fixing means such as bolts can interfere with the smooth and proper operation of the door.

It is an object of the present invention to provide a guide track for a folding barrier which avoids or reduces to a substantial extent the disadvantages referred to above, and an installation of the same in a floor of a doorway or the like.

SUMMARY OF THE INVENTION

The invention provides a guide track for a folding barrier comprising an elongated member of sheet material formed to have a channel-shaped cross-section having a basewall and two sidewalls upstanding therefrom, each sidewall having a top edge remote from said basewall, and extending from said top edge of each sidewall a securing flange, each securing flange being inclined relative to the respective sidewall from which it extends. Each securing flange may be inclined at an external angle of between 100° and 170°, preferably between 140° and 160°, wherein the included angle is between 10° and 80°, and preferably between 20° and 40° as seen in FIG. 1, to the respective sidewall.

Each securing flange may have an edge remote from the respective sidewall and a lip is provided at said remote edge. Each of said lips may extend in a direction away from said basewall and said sidewalls, and may be inclined to the respective securing flange at an external angle of between 60° and 180°, preferably between 130° and 140° wherein the included angle is preferably between 40° and 50°, as seen in FIG. 1.

Said remote edges of said securing flanges may be substantially in the plane of said basewall.

Said sidewalls may diverge in a direction away from said basewall and may diverge at an included angle of between 3° and 15°. Preferably said sidewalls are of substantially equal height.

The guide track may be of metal, for example mild steel and may have a protective treatment applied thereto, for example galvanising.

The invention also provides an installation of a guide track as aforesaid in a floor wherein said guide track is located in a recess in said floor with said top edges of said sidewalls substantially in the plane of the floor surface and the material of said floor being disposed in contact with that surface of each sidewall remote from the other sidewall and with both surfaces of each securing flange. Preferably the guide track comprises a lip at an edge of each securing flange remote from the respective sidewall, and the material of said floor is disposed in contact with both surfaces of each lip.

BRIEF DESCRIPTION OF THE DRAWINGS

The invention will now be further described with reference to the accompanying drawing, in which.

DESCRIPTION OF THE PREFERRED EMBODIMENT

Figure 2:
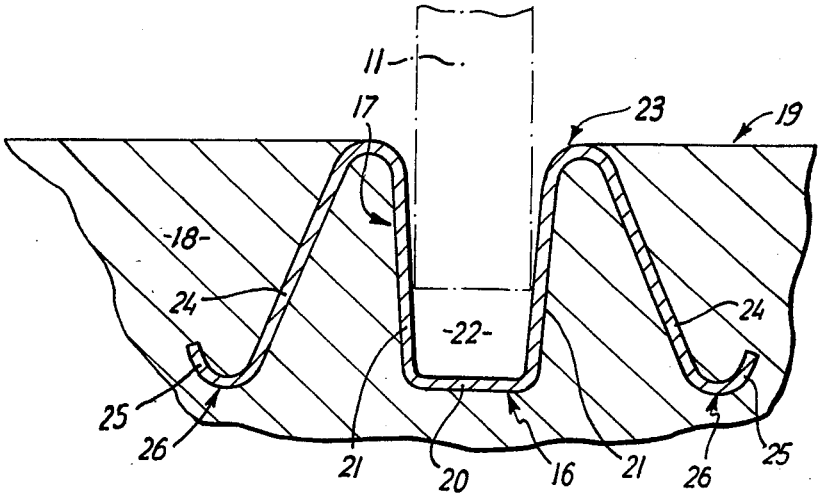
FIG. 2 is an enlarged cross-section of the guide track of FIG. 1.
Figure 1:
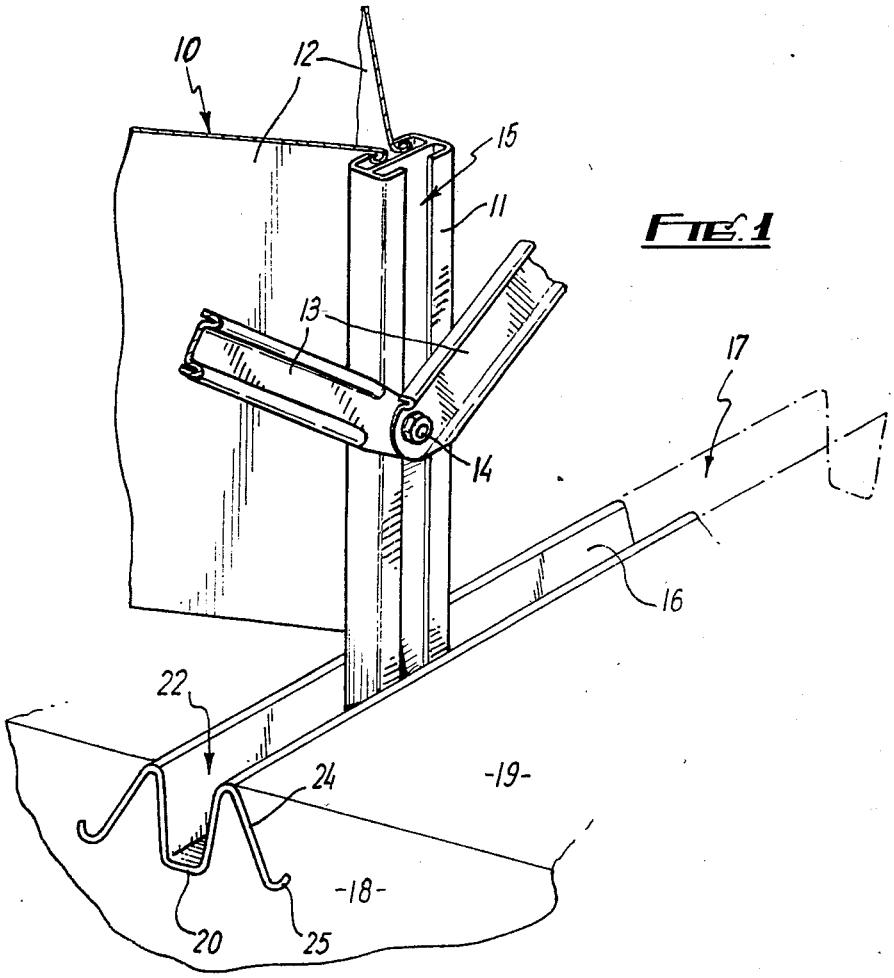
FIG. 1 is a scrap perspective view, partly in section of a guide track and folding door assembly.

Referring now to the figures there is shown a folding door assembly 10 comprising a vertically disposed picket 11 and leaves 12 hingedly secured therein. Lattice bars 13 are slidably secured to the picket 11 by means of a bolt 14 whose head is slidably retained in a channel formation 15 of the picket 11.

The door structure 10 is supported at the top thereof by the door frame structure (not shown) and the bottom ends of the pickets 11 are guided in guide track 16. The guide track 16 is located in a recess 17 in the floor 18 so that it does not protrude above the floor surface 19. In consequence, vehicles and/or heavy equipment may readily pass through the doorway without having to rise up over the guide track 16, thereby reducing the risk of damage to the vehicle, equipment or guide track 16.

The guide track 16 comprises a basewall 20 and two sidewalls 21 upstanding therefrom to form a channel 22 in which the bottom ends of pickets 11 are received. The sidewalls 21 diverge upwardly at an included angle of approximately 7° so that only line contact occurs between the picket 11 and the sidewalls 21. By this means friction between the picket 11 and sidewalls 21 is minimised, thereby facilitating easy opening and closing of the door structure 10.

The top edges 23 of sidewalls 21 are at the level of floor surface 19 and extending from each top edge 23 is a securing flange 24. The securing flange 24 is inclined at an external angle of approximately 150° to the respective sidewall 21 and has a lip 25 at the edge 26 remote from that sidewall 21. The lips 25 extend at an external angle of approximately 135° to the respective securing flange 24 and the edges 26 lie in the plane of basewall 20. The securing flanges 24 and the lips 25 are embedded in the floor 18, which may be for example of concrete, so that the floor material fills the spaces between the sidewalls 21 and the securing flanges 24. This provides good support for the sidewalls 21 to resist deformation under loads applied thereto by misuse of the door, i.e. under vehicular impact or the like. Since the lips 25 are effectively encased in the floor material, there is very high resistance to the guide track 16 being dislodged by such loads as aforementioned. Furthermore, the top edges 23 of sidewalls 21 and securing flanges 24 provide a secure edge to the channel 22 which is resistant to damage by vehicles passing thereover, providing protection for the concrete or the like which might otherwise chip or crumble in the region of the channel edge.

What is claimed is:

1. A guide track and floor structure for a folding barrier comprising:

an elongated member of sheet material having a channel-shaped cross-section received and embedded within said floor for sliding movement of a said folding barrier therein in controlling access to a said floor area on either side thereof, said guide track including a central base wall forming the bottom of said track, and two side walls extending upwardly and outwardly from either side of said base wall, the said side walls diverging with respect to each other at a small angle to the vertical for receiving therein and laterally confining portions of said folding barrier while the latter may slide longitudinally therealong, said side walls at the upper ends thereof merging respectively into reversely bent downwardly and outwardly inclined securing flanges extending longitudinally along said side walls and diverging with respect to each other along the length thereof, the junctures between said side walls and said securing flanges lying substantially in the plane of the floor within which said guide track is embedded, each said securing flange terminating in a reversely curved upwardly and outwardly directed terminal lip along the length thereof, the entirety of said securing flanges from said junctures with the side walls, and said terminal lips thereof being fully embedded within said floor to anchor said track, whereby said guide track channel thereof defined by said base wall and said side walls is in upwardly open relation to receive a folding barrier therein, and said diverging sidewalls provide clearance therefor while said diverging securing flanges and reversely curved terminal lips provide secure anchoring means embedded within said floor for extended service life of said guide track.

2. A guide track as claimed in claim 1 wherein each securing flange is inclined at an angle of between 10° and 80° to the respective sidewall.

3. A guide track as claimed in claim 1 wherein each lip is inclined to the respective sidewall at an angle of between 60° and 180°.

4. A guide track as claimed in claim 1 wherein the junctures between said securing flanges and the reversely curved terminal lips thereof are substantially in the plane of said base wall.

5. A guide track as claimed in claim 1 wherein said side walls diverge from the vertical at an included angle of between 3° and 15°.

6. A guide track as claimed in claim 1 wherein said sidewalls are of substantially equal height.

7. A guide track as claimed in claim 1 of galvanised mild steel material.

8. The guide track of claim 1 further including a plurality of vertically arranged pickets mounted for sliding movement within said channel defined by said base wall and diverging side walls, a plurality of door leaves hinged to said pickets, and to each other, and a lattice structure extending between said pickets and slidably engaged therewith whereby said pickets, leaves and lattice structure define a folding barrier movable in said guide track.

* * * * *